US010773357B2

(12) United States Patent
Brandl et al.

(10) Patent No.: US 10,773,357 B2
(45) Date of Patent: Sep. 15, 2020

(54) METHOD FOR MACHINING A SURFACE OF A COMPONENT

(71) Applicant: AUDI AG, Ingolstadt (DE)

(72) Inventors: Erhard Brandl, Eitensheim (DE); Maurice Langer, Dresden (DE); Thomas Kuntze, Dresden (DE)

(73) Assignee: AUDI AG, Ingolstadt (DE)

( * ) Notice: Subject to any disclaimer, the term of this patent is extended or adjusted under 35 U.S.C. 154(b) by 323 days.

(21) Appl. No.: 15/762,796

(22) PCT Filed: May 30, 2016

(86) PCT No.: PCT/EP2016/000883

§ 371 (c)(1),
(2) Date: Mar. 23, 2018

(87) PCT Pub. No.: WO2017/059935

PCT Pub. Date: Apr. 13, 2017

(65) Prior Publication Data

US 2018/0243883 A1 Aug. 30, 2018

(30) Foreign Application Priority Data

Oct. 9, 2015 (DE) ..... 10 2015 013 167

(51) Int. Cl.
*B24C 1/04* (2006.01)
*B24C 1/06* (2006.01)
(Continued)

(52) U.S. Cl.
CPC ..... *B24C 1/04* (2013.01); *B24C 1/06* (2013.01); *B24C 1/08* (2013.01); *B24C 3/065* (2013.01);
(Continued)

(58) Field of Classification Search
CPC .... B24C 1/04; B24C 1/06; B24C 1/08; B24C 7/00; B24C 7/0046; B24C 7/003; B24C 9/00; B44C 1/221
(Continued)

(56) References Cited

U.S. PATENT DOCUMENTS 2,448,316 A * 8/1948 Lawrence ..... B24C 3/12 425/385
2,923,109 A * 2/1960 Pelley ..... B24C 3/10 451/37
(Continued)

FOREIGN PATENT DOCUMENTS

CN 101740664 A 6/2010
DE 4415094 A1 11/1995
(Continued)

OTHER PUBLICATIONS

German Office Action dated Sep. 19, 2017 of corresponding application No. DE10 2015 013 167.2, 8 pgs.
(Continued)

*Primary Examiner* — George B Nguyen
(74) *Attorney, Agent, or Firm* — Maier & Maier, PLLC

(57) ABSTRACT

A method for machining at least one portion of a surface of a component for a vehicle, which is painted with a layer of clear coat of a given first layer thickness. The component is situated in an inner space of a blasting chamber. An opening of at least one conveying device for a blasting material emerges into the inner space. The inner space of the blasting chamber and the component are placed entirely under a partial vacuum. Blasting material in a carrier air flow generated by the partial vacuum is supplied through the opening of the conveying device to the inner space. The portion of the surface being machined and the opening of the conveying device are moved relative to each other. The
(Continued)

blasting material is shot from the opening of the conveying device onto the portion of the surface being machined.

12 Claims, 2 Drawing Sheets

(51) Int. Cl.

| | |
|---|---|
| ***B24C 1/08*** | (2006.01) |
| ***B24C 3/06*** | (2006.01) |
| ***B24C 7/00*** | (2006.01) |
| ***B44C 1/22*** | (2006.01) |
| ***B24C 9/00*** | (2006.01) |

(52) U.S. Cl.
CPC ..... *B24C 7/00* (2013.01); *B24C 7/0046* (2013.01); *B24C 9/00* (2013.01); *B24C 9/003* (2013.01); *B44C 1/221* (2013.01); *B24C 7/003* (2013.01)

(58) Field of Classification Search
USPC ..... 451/38
See application file for complete search history.

(56) References Cited

U.S. PATENT DOCUMENTS

| | | | | | |
|---|---|---|---|---|---|
| 3,385,006 | A * | 5/1968 | Miller | B24C 3/12 | 451/38 |
| 3,545,996 | A * | 12/1970 | Duncan | C21D 7/06 | 427/198 |
| 4,818,570 | A * | 4/1989 | Milles | B44C 3/005 | 264/118 |
| 4,821,461 | A * | 4/1989 | Holmstrand | B24B 37/16 | 451/38 |
| 4,985,101 | A * | 1/1991 | Brown, Jr. | B24C 1/04 | 156/154 |
| 5,006,207 | A * | 4/1991 | Peterman | B24C 1/04 | 205/120 |
| 5,029,419 | A * | 7/1991 | Nakayama | B24C 1/083 | 451/38 |
| 5,107,629 | A * | 4/1992 | Boyd | B24C 1/06 | 451/36 |
| 5,163,253 | A * | 11/1992 | Carpenter, Jr. | B24C 3/088 | 451/38 |
| 5,360,486 | A * | 11/1994 | Elliott | B08B 7/02 | 134/6 |
| 5,989,355 | A * | 11/1999 | Brandt | B08B 7/02 | 134/10 |
| 6,004,190 | A * | 12/1999 | Trampusch | B24C 1/003 | 451/38 |
| 6,390,898 | B1 | 5/2002 | Pieper | | |
| 2004/0053561 | A1 | 3/2004 | Pieper | | |
| 2007/0213216 | A1 * | 9/2007 | Lindemann | B44C 5/00 | 503/227 |
| 2008/0026140 | A1 * | 1/2008 | Clark | B44D 5/00 | 427/140 |
| 2010/0122719 | A1 | 5/2010 | Mase et al. | | |
| 2010/0248592 | A1 * | 9/2010 | Israelson | C09G 1/02 | 451/28 |
| 2012/0252329 | A1 * | 10/2012 | Wald | B24D 3/00 | 451/527 |
| 2012/0315827 | A1 * | 12/2012 | Edman | B23Q 1/032 | 451/38 |
| 2016/0096253 | A1 * | 4/2016 | Givens | B24D 13/142 | 427/289 |
| 2016/0096254 | A1 * | 4/2016 | Givens | B24D 13/142 | 451/57 |

FOREIGN PATENT DOCUMENTS

| | | | | |
|---|---|---|---|---|
| DE | 29719266 | U1 | 12/1997 | |
| DE | 19711040 | A1 | 2/1998 | |
| DE | 19747838 | C2 | 7/2001 | |
| DE | 10032782 | C1 | 2/2002 | |
| DE | 10102924 | C1 | 6/2002 | |
| DE | 10216294 | A1 | 10/2003 | |
| DE | 10257241 | A1 | 10/2003 | |
| DE | 10230620 | C1 | 11/2003 | |
| DE | 10257241 | B4 | 8/2006 | |
| DE | 102006061435 | A1 | 6/2008 | |
| DE | 102008060776 | A1 | 6/2010 | |
| DE | 102014000137 | A1 | 3/2014 | |
| DE | 102010020691 | B4 | 9/2014 | |
| DE | 102014202603 | A1 | 8/2015 | |
| DE | 102015013167 | A1 * | 4/2017 | B24C 7/00 |
| EP | 1027188 | B1 | 7/2002 | |
| EP | 1353777 | B1 | 10/2004 | |
| EP | 2571657 | B1 | 4/2015 | |
| JP | 2001-210661 | A | 8/2001 | |
| JP | 2004-066415 | A | 3/2004 | |
| JP | 2006-102908 | A | 4/2006 | |
| JP | 2009-190129 | A | 8/2009 | |

OTHER PUBLICATIONS

International Search Report dated Aug. 24, 2016 of corresponding application No. PCT/EP2016/000883, 15 pgs.

Office Action dated Jan. 30, 2019 in corresponding Chinese Application No. 201680058642.4; 15 pages.

Notification of Transmittal of Translation of the International Preliminary Report on Patentability dated Apr. 19, 2018, in connection with corresponding international Application No. PCT/EP2016/000883 (6 pgs.).

* cited by examiner

METHOD FOR MACHINING A SURFACE OF A COMPONENT

CROSS-REFERENCE TO RELATED APPLICATIONS

This application claims priority from PCT Patent Application No. PCT/EP2016/000883, filed on May 30, 2016, entitled "Method for machining a surface of a component," which in turn claims priority to German Patent Application No. DE102015013167B4, filed on Oct. 9, 2015, entitled "Method for processing glossy lacquer surfaces," the entire contents of which are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

BACKGROUND

Field

The invention relates to a method for machining at least one portion of a surface of a component for a vehicle.

Description of the Related Art

A paint and a finishing surface play an important role in the purchasing of a vehicle. The most varied colors, color gradients, and color effects can be individually selected. Likewise, a surface appearance can be chosen. There are so-called clear coats whose surface appears glossy. On the other hand, there are matte clear coats or matte coats which give a flat finish.

The painting of a metallic body of a vehicle is composed of several coats, e.g., a cathode dip coating, a filler, a base coat and a clear coat. A painting of plastic body parts or plastic interior parts likewise is composed of several coats, e.g., a so-called primer or a filler, a base coat and a clear coat. In both cases, the paint coatings visible to the customer are the base coat, which defines the color and the effect (such as a metallic or pearl effect) and the clear coat on top of this, which seals the lower coats and protects against mechanical, chemical and physical factors, as well as lending color depth. For a glossy surface, the clear coat layer is microscopically smooth or polished, so that a reflecting surface is formed, which reflects incident light. If the surface is supposed to appear flat or matte, a matte clear coat is used (i.e., a matte coat). In this case, a matting agent is mixed in with the clear coat, making the surface microscopically rough and diffusely scattering the incident light, so that the light is reflected in almost every spatial direction. A matte coating can be applied locally or, if so desired by the customer, over the entire body. Such a matte coat is an optically high-value coating, which may cause substantial expense. The technical quality of a matte clear coat, e.g., in terms of scratch resistance or steam jet resistance, is generally less than a glossy clear coat, since a matting agent may negatively influence the technical properties of a layer of matte clear coat.

One alternative to painting with a matte coat which contains a matting agent in order to produce a matte surface is foils which are glued entirely or to partial surfaces of the vehicle. However, a gluing on of foils has less technical and optical quality than a painting.

For local matting of surfaces, e.g., for decoration, foils may also be used. But these do not achieve the optical, haptic and technical quality of a painting. Furthermore, foils may peel off, forming edges where dirt can be deposited thereon.

Alternatively, the surface could be manually masked, sanded down, and matte clear coated. But this process is very time-consuming.

In the case of painting, impurities such as dust inclusions, wetting disturbances, craters, pinpricks, etc., or scratches and other damage may occur in the cover layer, i.e., the clear coat layer. Since, as mentioned, the matte coat has a microscopically rough surface on account of the matting agent, such impurities and damage cannot simply be polished out, because this would microscopically smooth out the surface, making the paint surface appear glossy and thus optically different from the surrounding surface. Thus far, no local preparation of such an post-machined glossy surface to restore the original optical matte condition has been possible. Instead, the entire body part or an entire partial surface (such as a door) needs to be repainted. This increases the time required by the body part in production before it can be installed. In addition, the costs are increased by the extra expense of time and material.

A device for the machining of a surface of an object for a subsequent painting is known from the document DE 20 2014 010 585 U1. With this device, flow parameters of a shot medium which is defined by its grain size and degree of hardness are influenced, for the purpose of roughening the surface of the object.

From document JP 4/147986 A there is known an enameled surface for a component which looks like natural stone.

SUMMARY OF THE DISCLOSURE

Against this background, a method is proposed with the features of patent claim 1. Embodiments of the method will emerge from the dependent patent claims and the description.

The method according to the invention for the machining of at least one portion of a surface of a component is provided for a vehicle, wherein the surface is painted with a layer of clear coat of a given first layer thickness. During the performance of the method, the component is situated in an inner space of a blasting chamber, wherein an opening of at least one conveying device for a shot material or blasting agent emerges into the inner space. The inner space of the blasting chamber and the component arranged therein are placed entirely under a partial vacuum, wherein blasting material in a carrier air flow generated by the partial vacuum is supplied or dispensed through the opening for the at least one conveying device to the inner space. Furthermore, the portion of the surface of the component being machined and the opening of the at least one conveying device are moved relative to each other, wherein the blasting material is shot or deflected from the opening of the at least one conveying device onto the portion of the surface of the component being machined, wherein the blasting material is accelerated by the partial vacuum onto the portion of the surface of the structural component being machined.

With the method, for example, an originally glossy surface of the component is impacted by the blasting material inside the blasting chamber, removing particles from the clear coat, so that the surface becomes rough and therefore matted.

In addition, the blasting material is accelerated by at least one additional gas flow suctioned in by the partial vacuum and under at least atmospheric pressure before impinging onto the surface being machined to a terminal velocity which is greater than the flow velocity of the carrier air flow.

The terminal velocity is adjusted as a function of the type and shape of the surface being machined, the type of blasting material, the degree of loading of the carrier air flow with blasting material, the value of the partial vacuum in the carrier air flow, the blasting time and/or the blasting temperature.

Depending on the requirement, at least 1% and at most 50% of the given first layer thickness of the layer of clear coat is removed from the surface of the component, so that the surface of the component being machined becomes matted and a reduced second layer thickness of the layer of clear coat is formed. Of course, a repeat machining of the remaining layer of clear coat with the reduced second layer thickness is possible, which preserves the protective effect of the layer of clear coat.

In another embodiment of the method according to the invention, the resulting matte surface of the component of the vehicle is then polished to a glossy finish.

In one embodiment of the method according to the invention, the partial vacuum is adjusted to a value of at most 950 mbar, such as, for example, to a value of around 200 mbar.

In another embodiment of the method according to the invention, a volume flow of the blasting material is adjusted to approximately 1 kg/h to 100 kg/h, such as approximately 20 kg/h.

In yet another embodiment of the method according to the invention, free-flowing particles, such as a granulate and/or a powder, are used as blasting material for the removal of a portion of the layer of clear coat, these particles having a size of at least 15 μm and at most 250 μm or 2500 μm, such as 150 μm, the particles composed of sand, plastic, glass beads, crushed glass, dry ice and/or soda, for example, and a liquid such as water is optionally added to the blasting material.

In still another embodiment of the method according to the invention, the surface of the component is covered by a stencil except for the at least one portion being machined, using as the stencil a cover film of plastic or a metal plate.

The proposed method according to the invention is to be carried out, for example, with a device for machining at least one portion of a surface of a component for a vehicle, wherein the surface is painted with a layer of clear coat of a given first layer thickness. The device comprises a blasting chamber with an inner space, at least one conveying device for a blasting material and at least one pump as a suction device. An opening of the at least one conveying device emerges into the inner space. The component is to be arranged in the inner space. Then the at least one pump is to be activated, wherein the at least one activated pump is designed to place the inner space of the blasting chamber and the component arranged therein completely under a partial vacuum, while blasting material is to be dispensed to the inner space through the opening of the at least one conveying device in a carrier air flow generated by the partial vacuum. At the same time, the portion of the surface being machined and the opening of the at least one conveying device are to be moved relative to each other, wherein the blasting material is to be shot from the opening of the at least one conveying device onto the portion of the surface being machined, for example by being steered onto it, wherein the blasting material is to be accelerated by the partial vacuum onto the portion of the surface being machined.

The device comprises at least one transport mechanism for the component, which is designed for the purpose of moving the component in the inner space of the blasting chamber, for example relative to the opening of the at least one conveying device. The transport mechanism comprises, e.g., a conveyor belt, which is arranged in the inner space of the blasting chamber and by which the component arranged thereon is to be moved. Alternatively or in addition, the device comprises at least one transport mechanism for the opening of the at least one conveying device, which is designed or the purpose of moving the opening of the at least one conveying device in the inner space of the blasting chamber, e.g., relative to the component.

The at least one conveying device is generally connected to a container where the blasting material is stocked.

The at least one pump is designed for the purpose of suctioning the blasting material from the inner space by creating the partial vacuum. Furthermore, the at least one pump is connected by at least one line to the at least one conveying device and is designed to provide the blasting material suctioned out from the inner space to the at least one conveying device again, the blasting material being brought by the pump to the container. For this, a cleaning mechanism is optionally provided, which is coordinated with the container and/or placed upstream from it, and which is designed to clean blasting material which is delivered from the inner space upstream from the pump. For this purpose, the residues of the clear coat layer which have been removed from the surface are to be separated from the blasting material.

It is thus possible to suction the blasting material out from the inner space of the blasting chamber from the surface being machined, to clean it, and to deliver it back to the carrier air flow, thereby providing a closed circuit for the blasting material.

Thus, a method is proposed for the machining of a glossy surface of the component, which is painted with a layer of clear coat of a given first layer thickness. In this case, the blasting material is dispensed into a carrier air flow of the conveying device generated by the partial vacuum in the inner space of the blasting chamber by means of gravity and/or an injector effect, delivered by a hose conduit system of the conveying device to the blasting chamber, which is under partial vacuum, and guided by a blasting lance, comprising the opening of the conveying device, deflected onto the component and its surface, returned from there to the air flow, cleaned and optionally returned in the circuit, wherein the acceleration of the blasting material is created by the partial vacuum and the component is moved in the blasting chamber relative to the opening of the blasting lance, wherein the blasting material is provided with at least one additional energy impetus by at least one additional gas flow, suctioned in by the partial vacuum and under at least atmospheric pressure, in order to attain a terminal velocity significantly higher than the flow velocity of the carrier air flow upstream from a dispensing site on the surface, wherein the terminal velocity establishes an energy input into the surface being machined as a function of the type and shape of the surface being machined as well as that of the blasting material, the degree of loading of the carrier air flow with blasting material, the value of the partial vacuum in the carrier air flow, the blasting time, and the blasting temperature.

Since the blasting chamber completely encloses the component and the entire component is under partial vacuum, the surface of the component is only impacted by the blasting material shot onto it. Other than this, no other force acts on the component, since no tool touches its surface, such as might additionally roughen the surface with blasting agent. Accordingly, this prevents a tool from abrading an already blasted surface, so that incompletely suctioned blasting material remaining on the component or getting in between the tool and the surface does not abrade the surface and possibly scratch the component.

When carrying out the method, approximately 1 to 50% of the given first layer thickness of the layer of clear coat is removed, thereby giving the surface a matte finish and forming a reduced second layer thickness of the layer of clear coat; however, a repeat machining of the remaining layer of clear coat with the reduced second layer thickness is permitted and the protective effect of the layer of clear coat is preserved.

Since the component is now placed entirely under partial vacuum, no inhomogeneously distributed force acts on the component's surface, which might stress and damage the component.

A matte treatment of the glossy or matte coated surface is possible by means of pressure blasting, i.e., particle and liquid blasting, such as sand blasting, plastic particle blasting, glass bead blasting, or crushed glass blasting with water, dry ice blasting, and/or soda blasting.

By contrast with conventional particle blasting, such as pressure blasting, the method which may also be called vacuum suction blasting accomplishes an effective and reproducible roughening in the uppermost layers of the surface, which is only a few micrometers thick, without the drawbacks of dust production, particle embedding, poor control capability and possibly poor homogeneity. The blasting material is accelerated solely by an application-adapted evacuating of the inner space of the blasting chamber by the pump. Immediately after the interaction with the component, the blasting material is suctioned out by the pump, along with the material removed. The vacuum suction blasting produces an almost homogeneous flow profile and thus very uniform impact velocities of the blasting material or the blasting particles onto the surface being machined. In this way, a desired treatment result can be established very precisely, making possible a removal of material exact to the submicrometer level.

In addition, the optical, haptic and technical quality of a clear coat painting can be utilized, which also reflects the design brand of a trademark, since adhesive foils need not be used. Already existing OEM coats can likewise be matted with the method of the invention and require no new granting of approval.

Further benefits and embodiments of the invention will emerge from the description and the accompanying drawings.

Of course, the features mentioned above and yet to be explained below may be used not only in the respective indicated combination, but also in other combinations or standing alone, without leaving the scope of the present invention.

BRIEF DESCRIPTION OF THE DRAWING

The invention is represented schematically on the basis of embodiments in the drawings, and will be described schematically and in detail, making reference to the drawings.

The figures shall be described coherently and comprehensively. The same reference numbers are used for the same components.

DETAILED DESCRIPTION OF THE DRAWING

Figure 1:
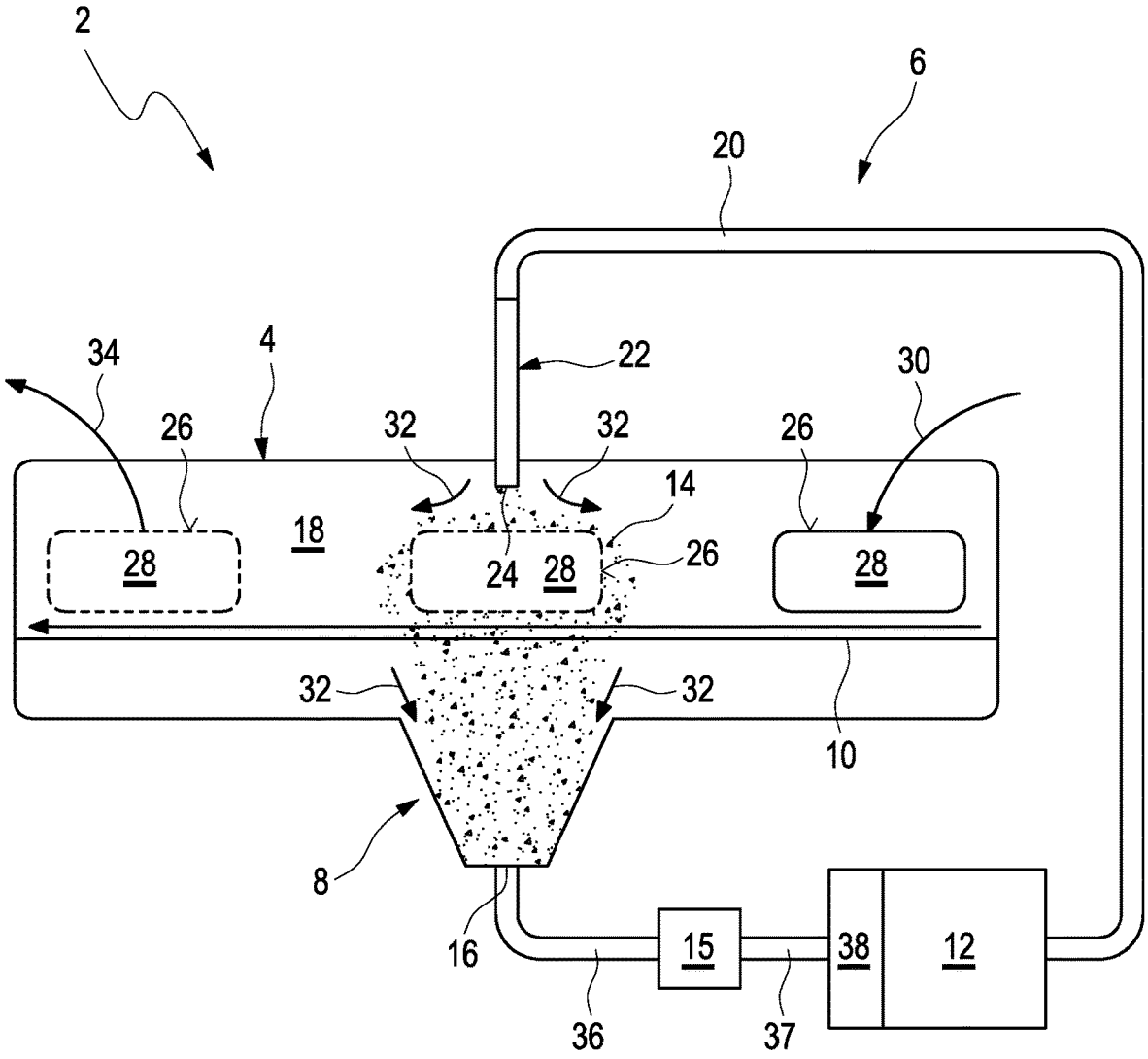
FIG. 1 shows in schematic representation a first example of a device for carrying out a first embodiment of the method according to the invention.

The example of the device 2 represented schematically in FIG. 1 comprises a blasting chamber 4, a conveyor device 6, a hopper 8, a transport mechanism 10, and a container 12 for a blasting material 14, composed here of free-flowing particles.

The hopper 8 is connected by a line 36, deigned here as a hose, to a pump 15. If the pump 15 is turned on, a partial vacuum is created in the inner space 18 by an opening 16 of the line 36, this opening 16 also being designed at the same time as an opening of the inner space 18 of the blasting chamber 4. As long as the partial vacuum prevails in the inner space 18 of the blasting chamber 4, blasting material is suctioned from the container 12, here via another line 20 of the conveying device 6 designed as a hose, to a blasting lance 22 of the conveying device 6 and further shot through an opening 24 of the blasting lance 22 and thus of the conveying device 6 into the inner space 18 of the blasting chamber 4, thus being delivered into this inner space 18.

With this device 2 carrying out the first embodiment of the method of the invention, it is possible to machine a surface 26 of a component 28, usually a component 28 for a vehicle or a motor vehicle, the surface 26 having a layer of clear coat painted on the component 28.

At first, it is provided that the conveying device 6 and the pump 15 are deactivated and a normal atmospheric pressure prevails in the inner space 18. Furthermore, the component 28, as indicated by a first curved arrow 30, is arranged through an opening of the blasting chamber 4, not shown further here, in the inner space 18 and arranged at a first end of the transport mechanism 10 inside the inner space 18. After this, the opening to the inner space 18 of the blasting chamber 4 is closed.

Once the component 28 whose surface 26 is to be machined has been arranged in the inner space 18, the conveying device 6 and the pump 15 are activated, whereby blasting material 14 is suctioned into the inner space 18. In addition, the component 28 is transported by the transport mechanism 10 relative to the opening 24 of the conveying device 6. Blasting material 14 impinges onto the surface 26, removing a portion of the layer of clear coat and giving the surface 26 a matte finish. The blasting material 14, as indicated by arrows 32, is at first shot onto the component 28 and then removed from the inner space 18 by way of the suction effect of the pump 15.

In the embodiment here it is proposed that the transport mechanism 10 is configured as a running belt or conveyor belt, on which the component 28 is to be placed. Furthermore, it is possible for the transport mechanism 10 to have only a carrier body on which the component 28 is placed, this carrier body being moved back and forth in the inner space 18, for example, on rails with the component 28 arranged thereon.

Regardless of the specific configuration of the transport mechanism 10, it is provided here that it has a plurality of openings through which the blasting material 14 can be transported to the opening 16 of the hopper 8 or the line 36. In this case, the running belt or the carrier body is fashioned as a lattice or a netting, for example.

Once the surface 26 of the component 28 has been sufficiently machined by removal of clear coat, and generally been rendered matte, the conveying device 6 and the pump 15 are shut off. Thus, once again the normal atmospheric pressure prevails in the inner space 18. After this, it is possible to remove the component 28 with the machined surface 26 from the inner space 18 through an opening of the blasting chamber 4, not shown further here, as indicated by the arrow 34.

Since the pump 15 is connected here by another line 37, which is designed as a hose, to the container 12, it is possible for the blasting material 14 to provide a closed circuit, wherein at least when the pump 15 is switched on, the blasting material 14 is delivered from the container 12 via the line 20 to the opening 24 of the conveying device 6 into the inner space 18 standing under partial vacuum, machining the surface 26 of the component 28. Furthermore, the blasting material 14 is transported by the pump 15 via the line 36 out from the inner space 18 and via the additional line 37 to the container 12, from which the blasting material 14 is to be transported once more to the opening 24 of the conveying device 6. It is possible to integrate a cleaning mechanism 38 in the container 12, which is designed to separate clear coat, usually residues or particles of the clear coat removed from the surface 26 of the component 28 by the blasting material 14, from the blasting material 14 delivered to the container 12. This cleaning mechanism 38 is designed as a sieve, for example.

Figure 2B:
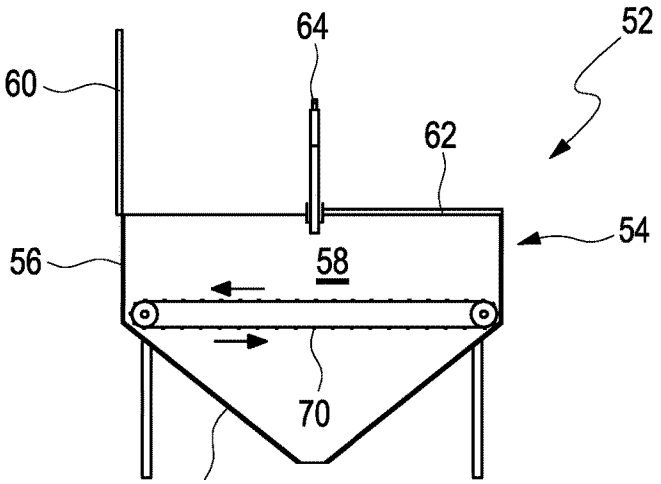
FIG. 2 shows in schematic representation a second example of a device for carrying out a second embodiment of the method according to the invention from different perspectives.
Figure 2C:
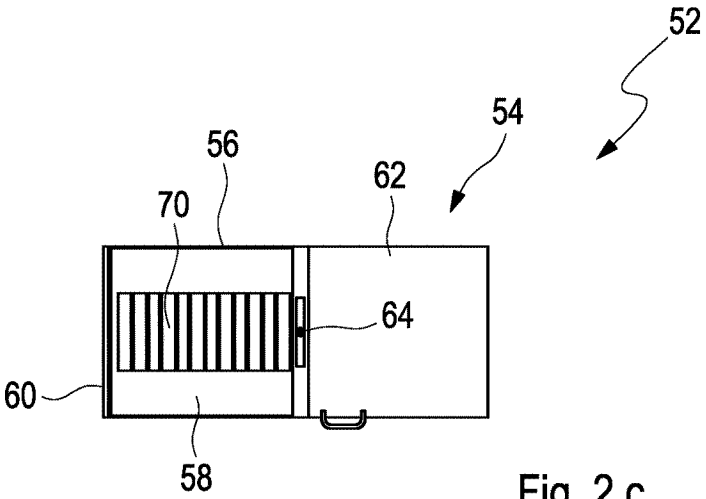
Figure 2A:
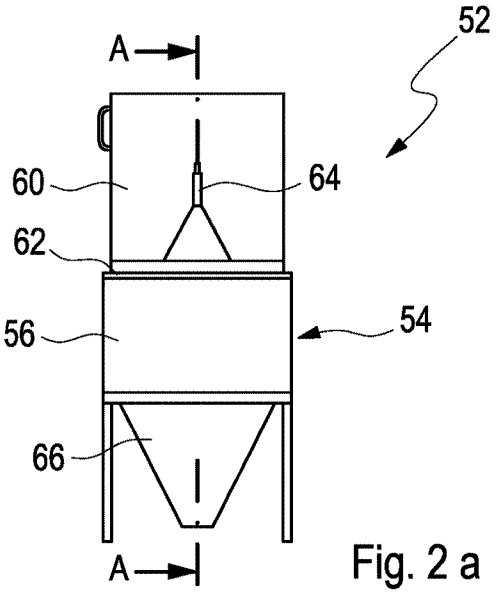

The second device 52 is represented schematically in FIG. 2*a* from the front, in FIG. 2*b* along a cross section A-A of FIG. 2*a* and in FIG. 2*c* from above. The device 52 comprises a blasting chamber 54, having a wall 56 which encloses an inner space 58 of the blasting chamber 54. On one surface of the blasting chamber 54 are arranged a first hatch 60, which is open here, and a second, closed hatch 62. Furthermore, on the top side there is arranged a conveying device 64, configured here as a blasting lance. A bottom side of the blasting chamber 54 is bounded here by a hopper 66, which comprises a pump, not shown further here. Moreover, the device 52 comprises a transport mechanism, which in turn comprises a conveyor belt 70, which is arranged in the inner space 58 of the blasting chamber 54. A component arranged on the conveyor belt 70 is to be moved in the inner space 58 of the blasting chamber 54 relative to the conveying device 64.

The second embodiment of the method according to the invention is designed for the machining of a surface of the component. The component has been painted with a layer of clear coat, forming the surface to be machined. In order to carry out the method, it is proposed at first that the component is arranged on the conveyor belt 70. After this, the inner space 58 is closed by shutting both hatches 60, 62. The conveying device 64, which here comprises a blasting lance whose opening emerges into the inner space, is connected by lines, not shown further here, to a container for blasting material. By activating the pump, a partial vacuum is created in the inner space 58 of the blasting chamber 54, by which the blasting material is suctioned from the openings of the conveying device 64 into the inner space 58. At the same time, after the transport mechanism is activated, the component arranged on the conveyor belt 70 is transported relative to the opening of the conveying device 64. The blasting material then strikes the surface of the component, partly removing the clear coat painted on it. Residues of the removed clear coat and blasting material are suctioned out from the inner space 58 by the pump. Moreover, it is possible to clean the blasting material of residues of clear coat and again provide it to the container for the conveying device 64.

The proposed method is suitable for the machining of a surface 26 of a component 28, designed as a body component or also as an interior component of a vehicle. With the method, a layer of clear coat can be machined, the clear coat not having any matting agents. As a result, the surface 26 of the component 28 becomes matted and a surface 26 with a matte appearance is formed. Existing layers of clear coat of high technical quality can be used when performing the method. Since only a fraction of the layer of clear coat is removed, a protective action of the layer of clear coat with respect to climate factors is preserved. By polishing the now matte surface 26, a matte effect can be polished out, so that the surface 26 once more appears glossy. In this way, it is possible to perform local repairs on painted surfaces. Likewise, matte decorations on a finish-coated body or interior component, such as trims and covers, can be applied to glossy surfaces 26 painted with clear coat. Moreover, a matte surface 26 can be polished once again, so that a glossy surface 26 is produced, which can then be matted once more with the proposed method. In this way, for example, flaws in matte surfaces 26 can be repaired. The protective action of the layer of clear coat remains preserved.

The invention claimed is:

1. A method for machining at least one portion of a surface of a component for a vehicle, which is painted with a layer of clear coat of a given first layer thickness, wherein the method comprises:

situating the component in an inner space of a blasting chamber, wherein an opening of at least one conveying device for a blasting material emerges into the inner space of the blasting chamber, placing the inner space of the blasting chamber and the component arranged therein entirely under a partial vacuum, generating, by a partial vacuum source, a carrier air flow for blasting material to be provided into the blasting chamber, wherein said partial vacuum source is provided opposite the opening of the at least one conveying device and downstream of said opening, supplying blasting material in the carrier air flow generated by the partial vacuum through the opening of the at least one conveying device to the inner space, wherein the portion of the surface being machined and the opening of the at least one conveying device are moved relative to each other, machining the surface by shooting the blasting material from the opening of the at least one conveying device onto the portion of the surface being machined, wherein the blasting material is accelerated, by suction action provided on the carrier air flow by the partial vacuum source, onto the portion of the surface being machined.

2. The method according to claim 1, wherein the blasting material is accelerated by combination with at least one additional gas flow suctioned by the partial vacuum source from the inner space, said at least one additional gas flow being under at least under atmospheric pressure, before impinging onto the surface being machined, wherein a terminal velocity of the impinging blasting material is greater than the flow velocity of the carrier air flow.

3. The method according to claim 2, in which the terminal velocity is adjusted, by operation of the partial vacuum source, as a function of the type and shape of the surface being machined, the type of blasting material, the degree of loading of the carrier air flow with blasting material, the value of the partial vacuum in the carrier air flow, the blasting time and/or the blasting temperature.

4. The method according to claim 1, in which at least 1% and at most 50% of the given first layer thickness of the layer of clear coat is removed from the surface of the component by machining the surface, whereby the surface of the component being machined becomes matte and a reduced second layer thickness of the layer of clear coat is formed.

5. The method according to claim 4, in which the resulting matte surface of the component is then polished to a glossy finish.

6. The method according to claim 1, in which the partial vacuum is adjusted to a value of at most 950 mbar.

7. The method according to claim 1, in which free-flowing particles are used as the blasting material for the removal of a portion of the layer of clear coat, these particles having a size of at least 15 μm and at most 350 μm, the particles comprising at least one of: sand, plastic, glass beads, crushed glass, dry ice and/or soda.

8. The method according to claim 1, in which the surface of the component is covered by a stencil except for the at least one portion being machined.

9. The method according to claim 6, wherein the partial vacuum is adjusted to 200 mbar.

10. The method according to claim 7, wherein a liquid, said liquid comprising at least one of: water or another liquid, is added to the blasting material.

11. The method according to claim 7, wherein the particles have a size of 150 μm.

12. The method according to claim 7, wherein the free-flowing particles are provided as at least one of a granulate and a powder.

* * * * *